US005929816A

United States Patent [19]

Gross et al.

[11] Patent Number: 5,929,816

[45] Date of Patent: Jul. 27, 1999

[54] ANTENNA MOUNT FOR AIRCRAFT

[76] Inventors: Terry R. Gross, P.O. Box 404, Timber Lake, S. Dak. 57656; Brett Barber, 902 Dogwood Dr., Box 395, Onida, S. Dak. 57565

[21] Appl. No.: 08/730,031

[22] Filed: Oct. 15, 1996

[51] Int. Cl.[6] ..... H01Q 1/28

[52] U.S. Cl. ..... 343/705; 343/878; 343/887

[58] Field of Search ..... 343/700 MS, 705, 343/708, 713, 878, 879, 887; 244/1 R, 62; 342/2, 26

[56] References Cited

U.S. PATENT DOCUMENTS 2,555,857 6/1951 Nelson et al. ..... 343/705
3,702,479 11/1972 Uhrig ..... 343/705
3,739,385 6/1973 Bechtel et al. ..... 343/705
5,182,566 1/1993 Ferguson et al. ..... 343/878

*Primary Examiner*—Hoanganh T. Le
*Assistant Examiner*—Tan Ho

[57] ABSTRACT

The antenna mount is for use in mounting a GPS antenna and a differential antenna on an aircraft. The antenna mount is fixed externally of the aircraft on an outer surface of a curved rear wall of the cockpit canopy. The antenna mount comprises a shell having a top wall for mounting at least one antenna, a front wall, side walls of substantially equal length, and a rear wall. The antenna mount is sized such that electronics required by the antenna may be placed such that they are enclosed therein. The mounting bolts are provided for fixing the antenna mount to the outer surface of the rear wall of the cockpit canopy.

19 Claims, 8 Drawing Sheets

ANTENNA MOUNT FOR AIRCRAFT

FIELD OF THE INVENTION

The present invention relates to an antenna mount particularly of the type for mounting a GPS antenna on an aircraft.

BACKROUND

Many light aircraft such as those used for agricultural purposes and by bush pilots are available without sophisticated instrumentation, particularly global positioning systems (GPS), This is true of both older aircraft produced before global positioning systems became available, and newer aircraft sold with a minimum of instrumentation. As global positioning systems become more widely used and less expensive they are more commonly being used on light aircraft for navigation and for special applications where precise positioning of the aircraft relative to the ground is essential. This is particularly true of crop spraying where precise positioning of the aircraft is needed to ensure that an area has been sprayed, and that time and money is not wasted by spraying the same area more than once.

As a result of the increasing use of GPS there is an increasing demand for retrofitting existing aircraft with GPS equipment. This requires that one or more GPS antennae be fitted onto the aircraft at a suitable location. Finding a suitable location to mount the antennae and the electronics which accompany them can be a problem. As well, mounting the GPS antenna must be done in such a way that any housing or cover used fits securely on the aircraft and has reasonable aerodynamic properties.

Some prior attempts at providing antenna mounts are know such as the one shown in U.S. Design Pat. No. 176,495 for use on an automobile. The antenna mount taught is primarily ornamental and does not have room to house any electronics that may be required by the antennae. Furthermore the antenna mount taught is not symmetrical in lateral cross section and therefore could not be mounted on the longitudinal centre line of an aircraft which in many cases is an aerodynamically desirable location.

A further prior attempt at providing an antenna mount provides a mount which has an upturned lip along its forward edge and side and rear walls extending perpendicularly downwards from the top wall to the aircraft. These features do not provide a superior aerodynamic surface when the mount is in place on the aircraft and may cause an unacceptable increase in drag. The angle and arrangement of the side and rear walls also leave little room to house any electronics that may be required by the antennae.

SUMMARY

According to a first aspect of the present invention there is provided an antenna mount for use with an aircraft having a cockpit canopy including a roof and a curved rear wall, said curved rear wall having an outer surface, said antenna mount comprising:

- a top wall having a substantially flat outer surface sized and arranged for receiving at least one antenna thereon, and a peripheral edge arranged around the outer surface;
- a bottom edge extending around a bottom of the antenna count and being spaced downwards and outwards from the peripheral edge;
- a front wall extending downwardly from the top wall to the bottom edge;

- a rear wall longer than the front wall extends downwardly and rearwardly from the top wall to the bottom edge such that the bottom edge slopes downwardly and rearwardly from the front wall to the rear wall;
- side walls of substantially equal length extending downwardly from the top wall to the bottom edge;
- at least one opening through the top wall for receiving a portion of the at least one antenna therethrough; and
- fixing means for fixing the antenna mount to the outer surface of the curved rear wall of the cockpit canopy.

The top wall preferably includes two openings, a first opening arranged adjacent a front end of the top wall to mount a first antenna, and a second opening arranged adjacent a rear end of the top wall to mount a second antenna.

Preferably the side wells are curved convex outwards from a top edge of the top wall to the bottom edge, and curve rearwards and laterally outwards from an end adjacent the front wall to an end adjacent the rear wall. The side walls are of a height sufficient to receive electronics associated with the at least one antennae therebetween.

Preferably the rear wall is curved convex outwards from a top edge of the top wall to the bottom edge, and curve rearwards and laterally inwards from an end adjacent the side wall to a rearward most end of the antenna mount.

The antenna mount preferably includes fixing means for fixing the at least one antenna to the top wall thereof.

According to a second aspect of the invention there is provided an aircraft comprising:

- a cockpit canopy comprising:
  - a roof;
  - at least one antenna; and
  - a curved rear wall having an outer surface extending downwards and rearwards of the roof, and downwards and laterally of a centre line extending longitudinally of the aircraft;
- an antenna mount comprising:
  - a top wall having a substantially flat outer surface sized and arranged for receiving at least one antenna thereon, and a peripheral edge arranged around the outer surface;
  - a bottom edge extending around a bottom of the antenna mount and being spaced downwards and outwards from the peripheral edge;
  - a front wall extending downwardly from the top wall to the bottom edge;
  - a rear wall longer than the front wall extends downwardly and rearwardly from the top wall to the bottom edge such that the bottom edge slopes downwardly and rearwardly from the front wall to the rear wall;
  - side walls of substantially equal length extending downwardly from the top wall to the bottom edge;
  - at least one opening through the top wall for receiving a portion of the at least one antenna therethrough; and
  - fixing means for fixing the antenna mount to the outer surface of the curved rear wall of the cockpit canopy.

The bottom edge of the mount is preferably arranged to follow the curvature of the outer surface of the cockpit canopy.

BRIEF DESCRIPTION OF THE DRAWINGS

In the accompanying drawings, which illustrate an exemplary embodiment of the present invention.

DETAILED DESCRIPTION

Figure 1:
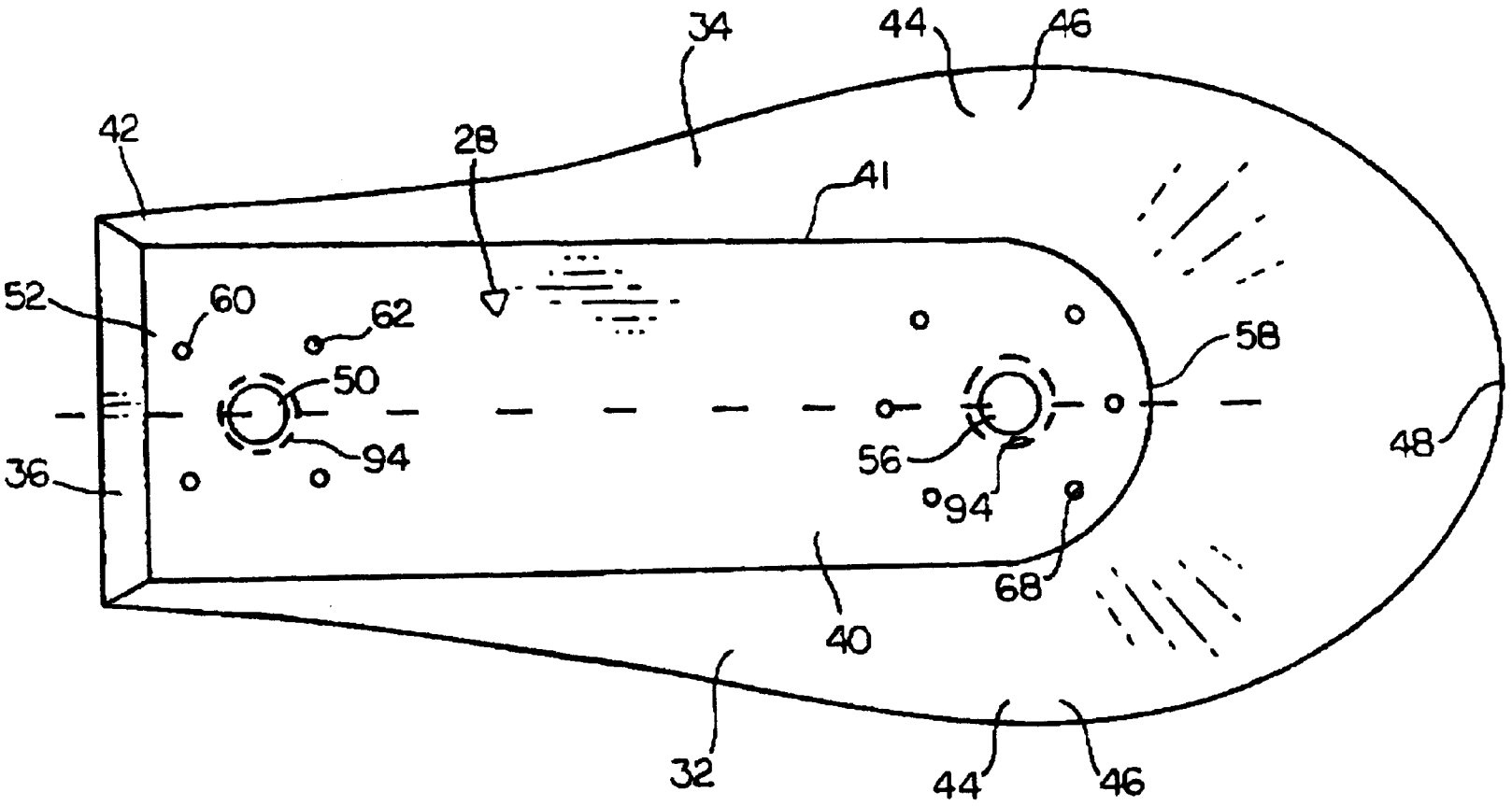
FIG. 1 is a top view of the antenna mount.
Figure 2:
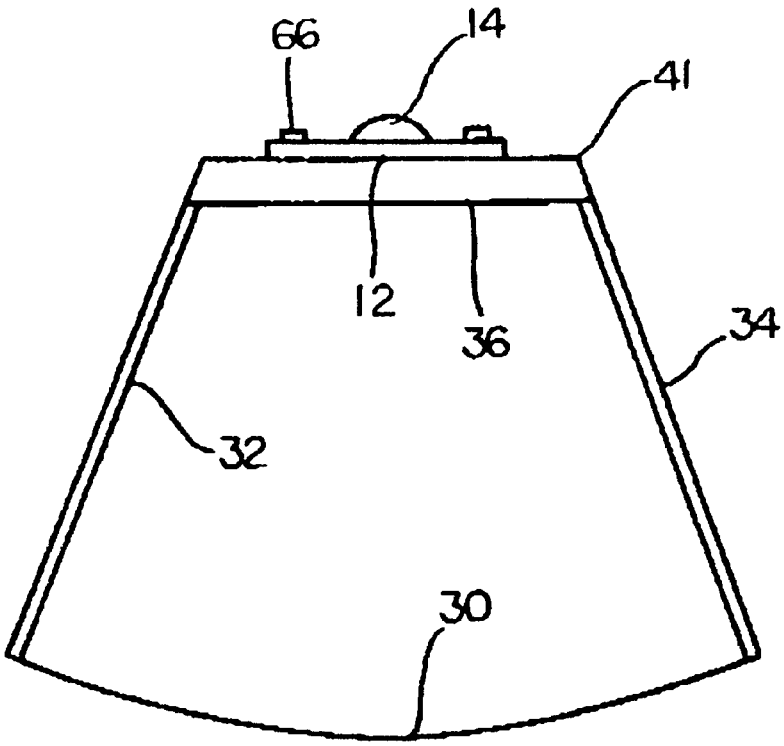
FIG. 2 is a rear view of the antenna mount.
Figure 3:
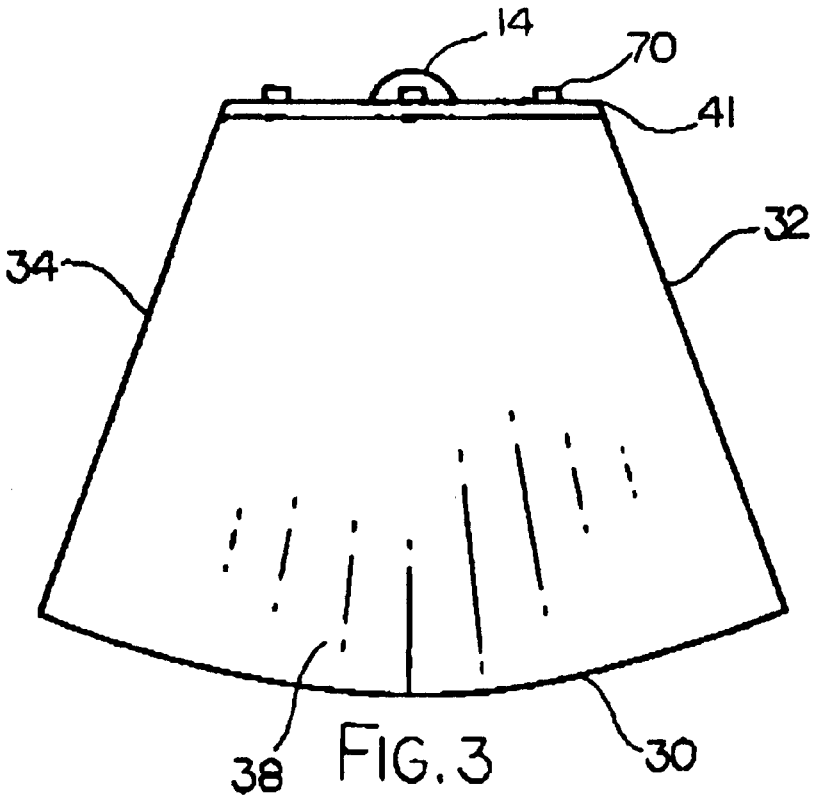
FIG. 3 is a front view of the antenna mount.
Figure 4:
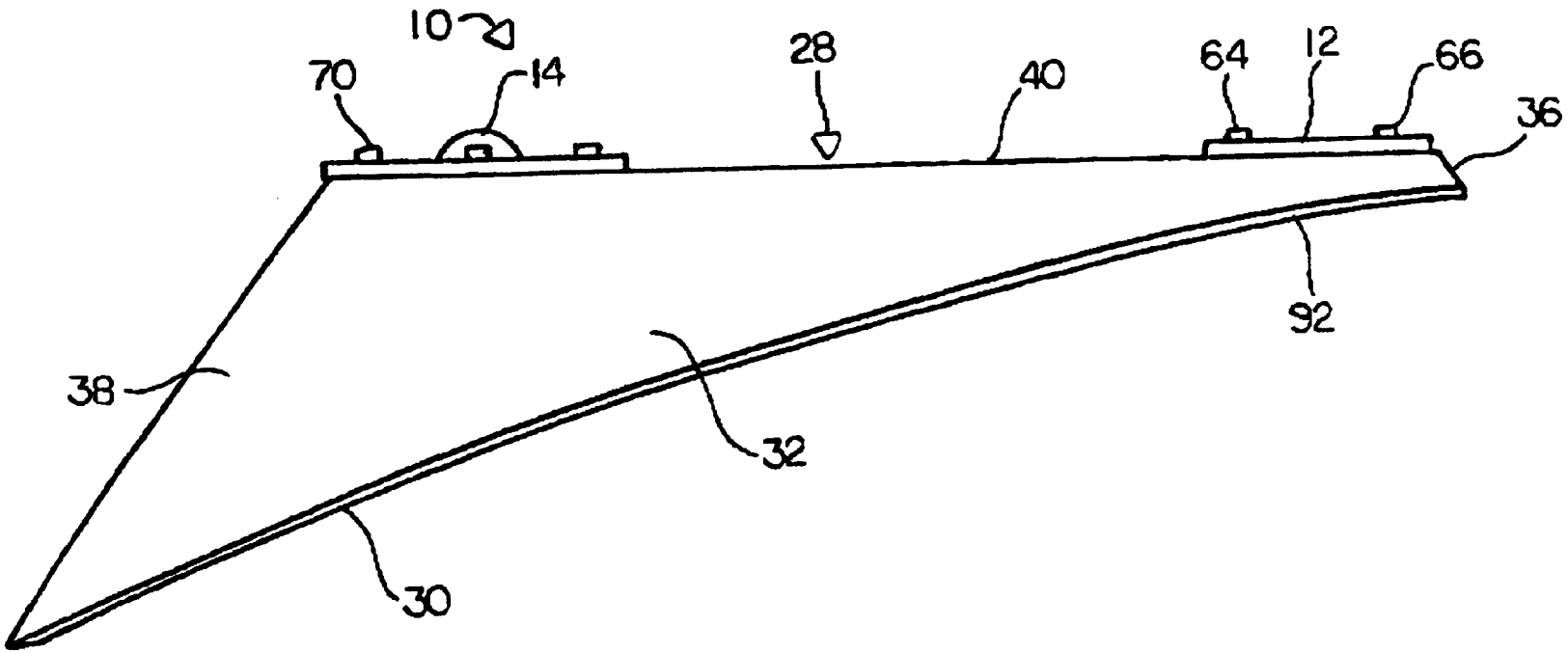
FIG. 4 is a right side view of the antenna mount.
Figure 5:
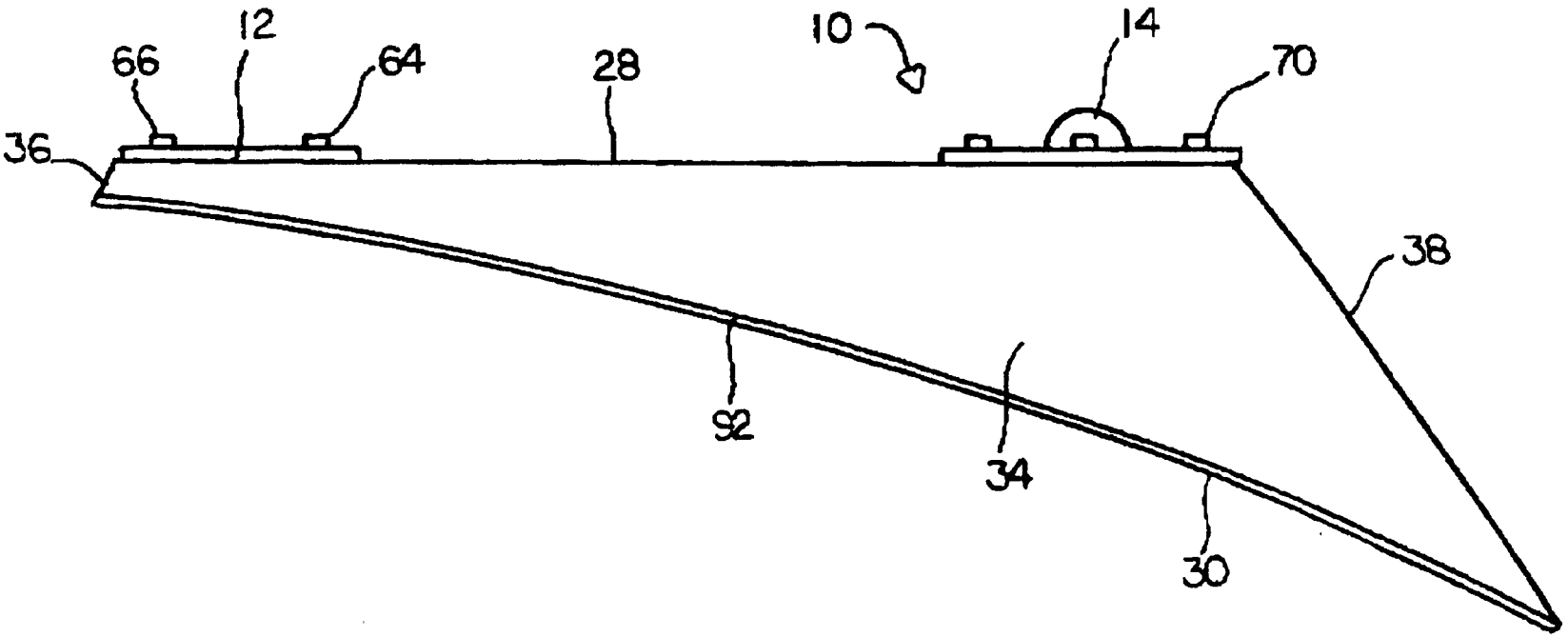
FIG. 5 is a left side view of the antenna mount.
Figure 8:
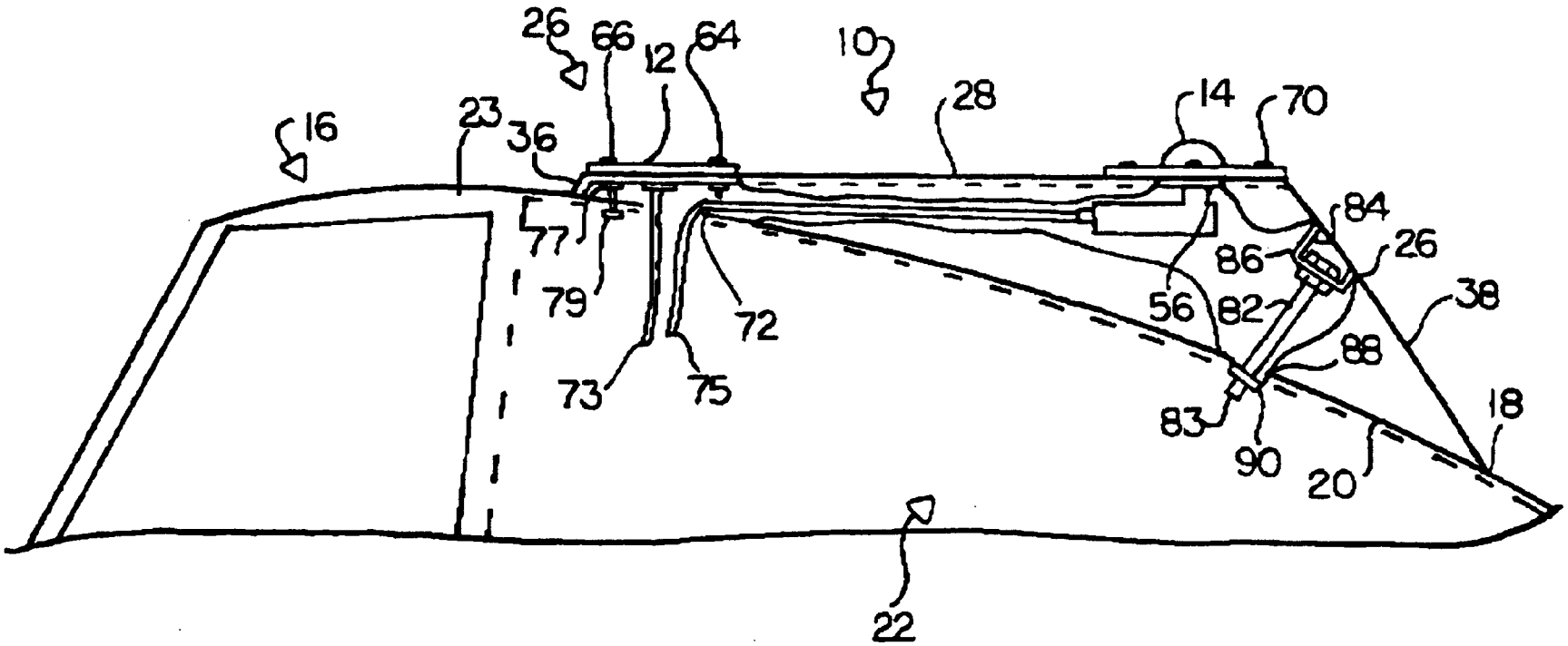
FIG. 8 is a cut away side view of the antenna mount on the cockpit of the aircraft.

Referring to FIGS. 1 and 8 the antenna mount is shown generally at 10. The antenna mount 10 is for use in mounting a GPS antenna 12 and a differential antenna 14 on an aircraft 16. The antenna mount 10 is fixed externally of the aircraft 16 on an outer surface 18 of a curved rear wall 20 of the cockpit canopy 22, and comprises a shell housing 24 and fixing means 26 for fixing the antenna mount 10 to the cockpit canopy 22.

Figure 6:
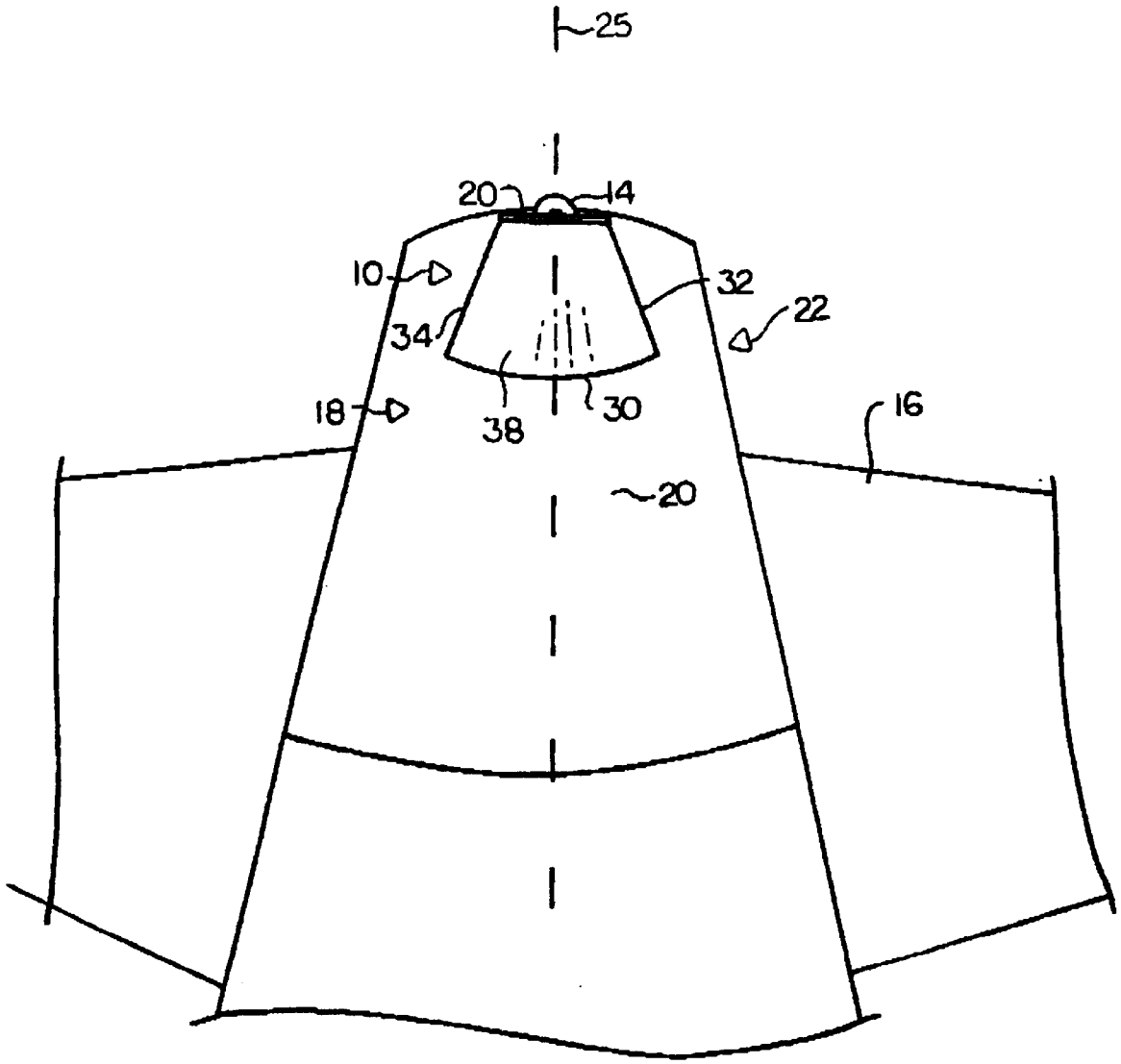
FIG. 6 is a rear view of the antenna mount mounted on the cockpit of the aircraft.
Figure 7:
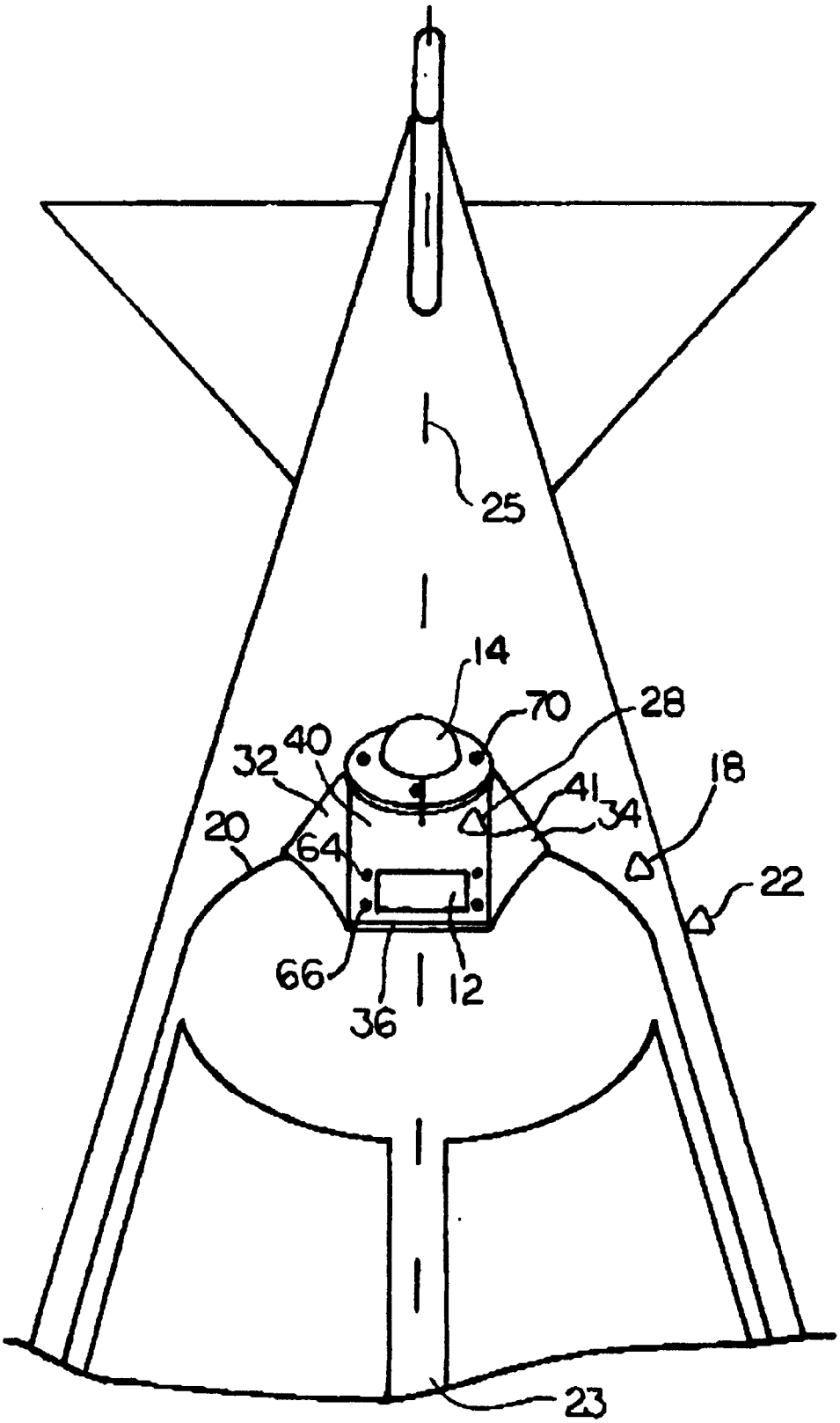
FIG. 7 is a view of the antenna mount mounted on the cockpit of the aircraft looking down on the antenna mount from in front and above.

Referring to FIGS. 6, 7, and 8 the aircraft 16 includes a cockpit canopy 22 which comprises a roof 23 and a curved rear wall 18 which has an outer surface 20 extending downwards and rearward of the roof 23 and downwards and laterally of a center line 25 which extends longitudinally of the aircraft 16.

Referring to FIGS. 1 to 5 the shell housing 24 of the antenna mount 10 includes a top wall 28, a bottom edge 30, side walls 32 and 34, a front wall 36, and a rear wall 38. The top wall 28 of the shell housing 24 has a substantially flat outer surface 40 arranged for receiving at least one antenna thereon, and a peripheral edge 41 extending entirely around the outer surface 40. The top wall 28 slopes slightly rearward and downwards when the antenna mount 10 is in place on the cockpit canopy 22 improving its aerodynamic characteristics, The bottom edge 30 of the antenna mount 10 extends around the bottom of the top, side, and rear walls of the antenna mount 10 and is spaced downwardly and outwardly from the peripheral edge 41. The bottom edge 30 slopes downwardly and rearwardly in a direction from the front wall towards the rear wall and is shaped to follow the curvature of the outer surface 18 of the cockpit canopy 22.

The side Walls 32 and 34 of the antenna mount 10 extend downwardly from the peripheral edge 41 of the top wall 28 and laterally outwards to the bottom edge 30. The side walls 32 and 34 curve convex outwards as they extend downwards from the top edge 41 of the top wall 28 to the bottom edge 30, and are substantially the same length making the antenna mount 10 symmetrical in lateral cross section allowing the antenna mount 10 to be positioned on the centre line 25 of the aircraft 16 which is often aerodynamically desirable. The side walls 32 and 34 are also of a sufficient height to allow electronics that may be required by the antennae to be enclosed within the mount 10.

The front wall 36 extends downwards from the peripheral edge 41 of the top wall 28 to the bottom edge 30 sloping downwardly and forwardly from the peripheral edge 41 of the top wall 28 to the bottom edge 30. The front wall 36 lies substantially perpendicular to the side walls 32 and 34 and extends therebetween.

The rear wall 38 slopes downwardly and rearwardly from the peripheral edge 41 of the top wall 28, and is curved convex outwards as it extends from a top edge 41 of the top wall 28 downwards to the bottom edge 30. The rear wall 38 is longer than the front wall 36 making the antenna mount 10 asymmetrical in longitudinal cross section such that the bottom edge 30 follows the downward and rearward curve of the rear wall 18 of the cockpit canopy 22.

To provide better aerodynamic characteristics the antenna mount 10 is curved longitudinally such that the side walls 32 and 34 and the rear wall 38 of the antenna mount 10 are shaped to provide this curvature. The side walls 32 and 34 curve rewards and laterally outwards from a front end 42 lying adjacent the front wall 36 to a back end 44 lying adjacent the rear wall 38. The rear wall 38 is curved rewards and laterally inwards from a front end 46 adjacent each of the side walls 32 and 34 to a rearward most end 48 of the rear wall 38 of the antenna mount 10, Referring to FIGS. 1, 8, and 9 the outer surface 40 of the top wall 28 is elongate and is substantially rectangular in shape with a rounded rear portion. The top wall 28 has a pair of openings for receiving a portion of each of the GPS antenna and the differential antenna therethrough. A first opening 50 is arranged adjacent the front end 52 of the top wall and is arranged to received the antenna cable 73 of the GPS antenna 12. A second opening 56 is arranged adjacent a rear end 58 of the top wall 28 to mount the differential antenna 14. The second opening 56 receives the antenna cable 75 from the differential antenna 14.

Arranged around the first opening 50 are a plurality of smaller holes for mounting the GPS antenna 12 on the top wall 28. Referring to FIGS. 1, 4, 5, 8, and 9 the mounting holes include a pair of holes 60 arranged adjacent the front of the top wall 28 and a pair of rear holes 62 arranged rearward of the front holes 60. The rear holes 62 receive bolts 64 which fasten the GPS antenna 12 in place on the top wall 28 and the front holes 60 receive bolts 66 which fasten the GPS antenna 12 to the top wall 28 of the antenna mount 10 and fasten the antenna mount 10 to the cockpit canopy 22.

Arranged around the second opening 56 are a plurality of holes 68 which fix the differential antenna 14 in place on the top wall 28 of the antenna mount 10. Each of the holes 68 receives a fastener 70 therethrough which holds the differential antenna 14 in place on the top wall 28.

The antenna mount 10 is arranged to lie on the cockpit canopy 22 with the bottom edge 30 in contact with the outer surface 20 of the cockpit canopy 22. The antenna mount 10 is arranged over an opening 72 in the canopy 22 which receives antenna cables 73 and 75 therethrough. The antenna cables 73 and 75 pass through the opening 72 into the cockpit of the aircraft 16 and are connected to appropriate electronics for interpreting the signal from the antennae 12 and 14 and displaying a signal to the pilot.

Figure 9:
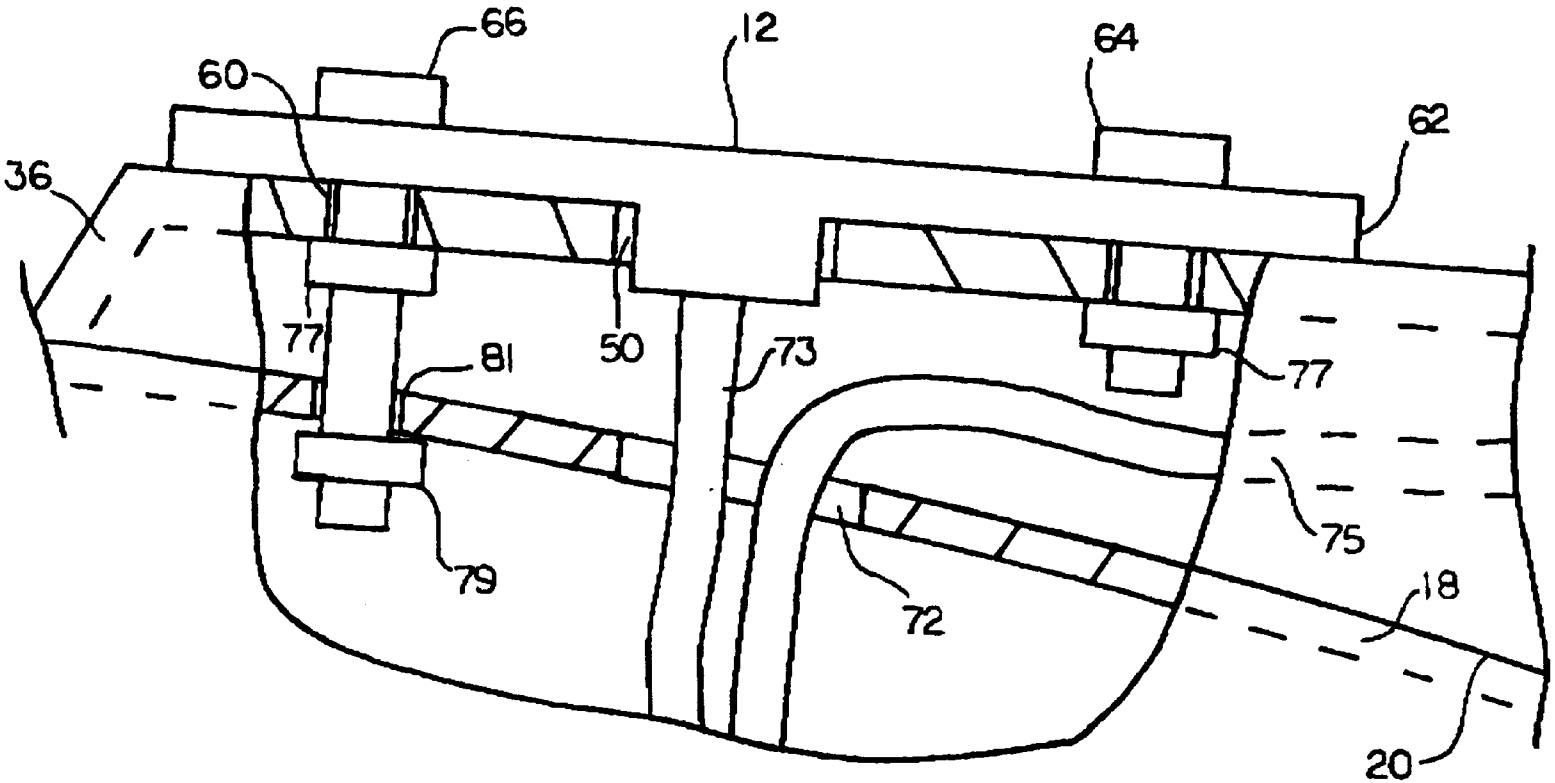
FIG. 9 is a cut away side view showing the fixing means for the front of the antenna mount and the GPS antennae.

Referring to FIGS. 8 and 9 the antenna mount 10 is fixed to the cockpit canopy 22 by fixing means which fix the antenna mount 10 to the outer surface 20 of the curved rear wall 18 of the cockpit canopy 22. The fixing means for the antenna mount 10 include the pair of bolts 66 which extend through the top wall 28 near the front end 52 of the said top wall 28, The bolts 66 each have a self-locking nut 77 arranged to hold the GPS antenna 12 in place on the top outer surface 29 of the top wall 28. A pair of holes 81 in the cockpit canopy 22 are arranged to align with the holes 60 in the top wall 28 of the antenna mount 10. The bolts 66 extend through the holes 81 in the canopy 22 and engage a pair of self-locking nuts 79 which hold the bolts in place thereby fixing the front end of the antenna mount 10 in place on the cockpit 22.

Referring to FIG. 8 the rear end of the antenna mount 10 is fixed to the cockpit by a mounting bolt 82 which is fixed at a top end to a bracket 84. The bracket 84 is fixed to the rear wall 38 of the antenna mount 10 and includes a slot 86 which allows the bottom end 83 of the bolt 82 to be selectively positioned into one of a range of positions. A hole 88 extends through the cockpit canopy 22 and is arranged to cooperate with the bolt 82 to receive the bottom end 83 of the bolt 82 therethrough. A self-locking nut 90 engages the bottom end 83 of the bolt 82 securing the rear of the antenna mount 10 in place on the cockpit canopy 22.

The antenna mount 10 is positioned on the curved rear wall of the cockpit canopy 22 at a position spaced downwards from the top wall of the cockpit canopy 22.

Around each of the openings 50 and 56 in the top wall 28 is a waterproof sealing means 94 for sealing the space between the top wall 28 and the bottom of each of the antennae 12 and 14. This seal 94 is generally provided by a silicone or similar type of sealant.

Arranged around the bottom edge 30 of the antenna mount 10 is a molding 92. The molding 92 seals the space between the bottom of the antenna mount 10 and the outer surface 18 of the cockpit canopy 22. The molding may also be augmented by silicone sealant like the one used at the openings 50 and 56.

Although two bolts are used at the front and one bolt at the rear to fix the mount 10 on the cockpit canopy 22, any appropriate number of bolts or any appropriate other means of fixing the antenna mount 10, for example rivets or adhesives, may also be used.

Although silicone type sealants 94 are used to seal the space between the antennae and the top wall 28, and between the bottom edge 20 and the canopy 22, any other appropriate means of sealing these spaces may also be used.

While one embodiment of the present invention has been described in the foregoing, it is to be understood that other embodiments are possible within the scope of the invention. The invention is to be considered limited solely by the scope of the appended claims.

We claim:

1. An antenna mount for use with an aircraft having a cockpit canopy including a roof and a curved rear wall, said curved rear wall having an outer surface, said antenna mount comprising:

a top wall having a substantially flat outer surface sized and arranged for receiving at least one antenna thereon, and a peripheral edge arranged around the flat outer surface;

a bottom edge extending around a bottom of the antenna mount and being spaced downwards and outwards from the peripheral edge;

a front wall extending downwardly from the top wall to the bottom edge;

a rear wall longer then the front wall extends downwardly and rearwardly from the top wall to the bottom edge such that the bottom edge slopes downwardly and rearwardly from the front wall to the rear wall;

side walls of substantially equal length extending downwardly from the top wall to the bottom edge;

at least one opening through the top wall for receiving a portion of the at least one antenna therethrough; and fixing means for fixing the antenna mount to the outer surface of the curved rear wall of the cockpit canopy.

2. An antenna mount according to claim 1 wherein the top wall includes two openings therethrough, a first opening arranged adjacent a front end of the top wall to mount a first antenna therein and a second opening arranged adjacent a rear end of the top wall to mount a second antenna therein, and wherein the antenna mount includes fixing means for fixing the at least one antenna to the top wall thereof.

3. An antenna mount according to claim 1 wherein the side walls are curved convex outwards from a top edge of the top wall to the bottom edge, and wherein rear wall is curved convex outwards from a top edge of the top wall to the bottom edge.

4. An antenna mount according to claim 1 wherein the side walls are curved rearward and laterally outwards from an end adjacent the front wall to an end adjacent the rear wall, and wherein the rear wall is curved rearward and laterally inwards from an end adjacent the side wall to a rearward most end of the antenna mount.

5. An antenna mount according to claim 1 wherein the front wall slopes downwardly and forwardly to the bottom edge.

6. An antenna mount according to claim 1 wherein the side walls slope downwardly and laterally from the top wall to the bottom edge and wherein the side walls are of a height to receive electronics associated with said at least one antennae therebetween.

7. An antenna mount according to claim 1 wherein the outer surface of the top wall slopes rearwardly.

8. An antenna mount according to claim 1 wherein the top wall is elongate.

9. An aircraft comprising:

a cockpit canopy comprising:

a roof;

at least one antenna; and a curved rear wall having an outer surface extending downwards and rearward of the roof, and downwards and laterally of a centre line extending longitudinally of the aircraft;

an antenna mount comprising:

a top wall having a substantially flat outer surface sized and arranged for receiving at least one antenna thereon, and a peripheral edge arranged around the flat outer surface;

a bottom edge extending around a bottom of the antenna mount and being spaced downwards and outwards from the peripheral edge;

a front wall extending downwardly from the top wall to the bottom edge;

a rear wall longer than the front wall extends downwardly and rearwardly from the top wall to the bottom edge such that the bottom edge slopes downwardly and rearwardly from the front wall to the rear wall;

side walls of substantially equal length extending downwardly from the top wall to the bottom edge;

at least one opening through the top wall for receiving a portion of the at least one antenna therethrough; and fixing means for fixing the antenna mount to the outer surface of the curved rear wall of the cockpit canopy.

10. An antenna mount according to claim 9 wherein the side walls slope downwardly and laterally outwardly of the centre line extending longitudinally of the aircraft from the top wall to the bottom edge.

11. An antenna mount according to claim 9 wherein the side walls are curved convex outwards from a top edge of the top wall to the bottom edge, and wherein rear wall is curved convex outwards from a top edge of the top wall to the bottom edge.

12. An antenna mount according to claim 9 wherein the side walls are curved rearward and laterally outwards from an end adjacent the front wall to an end adjacent the rear wall, and wherein the rear wall is curved rearward and laterally inwards from an end adjacent the side wall to a rearward most end of the antenna mount.

13. An antenna mount according to claim 9 wherein the at least one opening through the top wall includes sealing means arranged therearound.

14. An antenna mount according to claim 9 wherein the bottom edge of the antenna mount includes sealing means arranged therearound.

15. An aircraft according to claim 9 wherein the bottom edge is arranged to follow the curvature of the outer surface of the cockpit canopy.

16. An aircraft according to claim 9 wherein the fixing means comprise a pair of holes in the outer surface of the top wall of the antenna mount, a pair of threaded holes in the cockpit canopy, and a pair of threaded fasteners extending through the pair of holes in the outer surface of the top wall for engaging within the pair of threaded holes In the cockpit canopy.

17. An aircraft according to claim 9 wherein the fixing means comprise a threaded fastener fixed at a top end to an interior of the rear wall of the antenna mount and a threaded hole In the cockpit canopy arranged to cooperate with said threaded fastener.

18. An antenna mount according to claim 9 wherein top wall of the antenna mount is spaced downwards from the top wall of the cockpit canopy.

19. An antenna mount according to claim 9 including fixing means for fixing the at least one antenna to the top wall of the antenna mount.

* * * * *